US009114505B2

(12) United States Patent
Petersen

(10) Patent No.: US 9,114,505 B2
(45) Date of Patent: Aug. 25, 2015

(54) SANDPAPER WITH FIBROUS NON-SLIP LAYER

(75) Inventor: John G. Petersen, Center City, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 446 days.

(21) Appl. No.: 13/489,530

(22) Filed: Jun. 6, 2012

(65) Prior Publication Data

US 2012/0322351 A1 Dec. 20, 2012

Related U.S. Application Data

(60) Provisional application No. 61/498,677, filed on Jun. 20, 2011.

(51) Int. Cl.

| | |
|---|---|
| ***B24D 11/02*** | (2006.01) |
| ***B24D 3/00*** | (2006.01) |
| ***B24D 11/00*** | (2006.01) |

(52) U.S. Cl.

CPC ..... *B24D 11/02* (2013.01); *B24D 3/002* (2013.01); *B24D 11/001* (2013.01)

(58) Field of Classification Search

CPC ..... B24D 11/02; B24D 3/002; B24D 11/001
USPC ..... 51/295, 297, 298, 299, 307, 309; 451/526, 527, 533, 538, 539
See application file for complete search history.

(56) References Cited

U.S. PATENT DOCUMENTS

| | | | | |
|---|---|---|---|---|
| 3,030,742 | A | 4/1962 | Costello | |
| 4,202,139 | A | 5/1980 | Hong | |
| 4,714,644 | A | 12/1987 | Rich | |
| 5,109,638 | A | 5/1992 | Kime | |
| 5,382,615 | A | 1/1995 | Godfrey | |
| 5,514,028 | A | 5/1996 | Ali | |
| 5,807,161 | A | 9/1998 | Manor | |
| 5,984,989 | A | 11/1999 | Davison | |
| 6,110,015 | A | 8/2000 | Christianson | |
| 6,613,113 | B2 | 9/2003 | Minick | |
| 2002/0155283 | A1 * | 10/2002 | Carter et al. | 428/343 |
| 2003/0119437 | A1 | 6/2003 | Rich | |
| 2006/0246830 | A1 | 11/2006 | Kirschhoffer | |

(Continued)

FOREIGN PATENT DOCUMENTS

WO WO 2010-002697 1/2010

OTHER PUBLICATIONS

International Search Report, PCT/US2012/043327, mailed Dec. 14, 2012, 3 pages.

(Continued)

*Primary Examiner* — Timothy V Eley
(74) *Attorney, Agent, or Firm* — Kenneth B. Wood

(57) ABSTRACT

A sheet of sandpaper includes a backing layer having opposed first and second major sides, an adhesive make coat on the second major side, abrasive particles at least partially embedded in the make coat, thereby defining an abrasive surface, and an exposed fibrous non-slip layer on the first major side. Methods of making and using such sandpaper are also provided.

21 Claims, 2 Drawing Sheets

(56) References Cited

U.S. PATENT DOCUMENTS

| | | | | |
|---|---|---|---|---|
| 2007/0243802 | A1 | 10/2007 | Petersen | |
| 2009/0325470 | A1 | 12/2009 | Petersen | |
| 2010/0009604 | A1 | 1/2010 | Petersen | |
| 2012/0231707 | A1* | 9/2012 | Pahl et al. | 451/59 |
| 2012/0231708 | A1* | 9/2012 | Pahl et al. | 451/59 |
| 2012/0322351 | A1* | 12/2012 | Petersen | 451/539 |
| 2012/0322352 | A1* | 12/2012 | Petersen | 451/539 |
| 2014/0127977 | A1* | 5/2014 | Petersen | 451/59 |

OTHER PUBLICATIONS

International Search Report, PCT/US2012/027839, mailed Aug. 29, 2012, 3 pages.
U.S. Appl. No. 13/412,955, Pahl, filed Mar. 11, 2011.
U.S. Appl No. 13/412,924, Petersen, filed Mar. 6, 2012.
U.S. Appl. No. 13/494,590, Petersen, filed Jun. 6, 2012.

* cited by examiner

SANDPAPER WITH FIBROUS NON-SLIP LAYER

CROSS REFERENCE TO RELATED APPLICATION

This application claims the benefit of U.S. Provisional Patent Application No. 61/498677, filed Jun. 20, 2011, the disclosure of which is incorporated by reference herein in its entirety.

BACKGROUND

The present invention relates generally to abrasive articles for abrading a work surface such as, for example, flexible sheet-like abrasive articles.

Sheet-like abrasive articles are commonly used in a variety of sanding operations including, for example, hand sanding of wooden surfaces. In hand sanding, the user holds the abrasive article directly in his or her hand and moves the abrasive article across the work surface. Sanding by hand can, of course, be an arduous task.

Sheet-like abrasive articles include, for example, conventional sandpaper. Conventional sandpaper is typically produced by affixing abrasive material to a relatively thin, generally non-extensible, non-resilient, non-porous backing (e.g., paper). The thin, flat, slippery nature of conventional sandpaper backing materials makes conventional sandpaper difficult to grasp, hold, and maneuver. Because of the slippery nature of conventional sandpaper, to hold a sheet of sandpaper securely, a user will grasp the sheet of sandpaper between his or her thumb and one or more of his or her remaining fingers. Holding the sandpaper in this manner is uncomfortable, can lead to muscle cramps and fatigue, and is difficult to maintain for an extended period of time. In addition, the thumb is typically in contact with the abrasive surface of the sandpaper, which can irritate or damage the skin. Also, because the thumb is positioned between the sandpaper and the work surface, grasping the sandpaper in this manner also interferes with the sanding operation. That is, due to the position of the thumb, a portion of the sandpaper abrasive surface is lifted away from the work surface during sanding. Because the lifted portion is not in contact with the work surface, the full sanding surface of the sandpaper is not utilized, and the effectiveness of the sandpaper is, therefore, diminished.

During hand sanding, a user often applies pressure to the sandpaper using his or her fingertips. Because of the thin nature of the backing materials used in conventional sandpaper, the finger pressure is concentrated in the regions where the finger pressure is applied. This, in turn, causes the sandpaper to wear and/or load unevenly, and produces an uneven sanding pattern on the work surface.

Conventional sandpaper is typically sold in standard size sheets, such as 9×11 inch sheets. To make sandpaper easier to use, users often fold the sandpaper, thereby producing smaller sheets that are easier to handle. Folding the sandpaper, however, produces a jagged edge, and also weakens the sandpaper along the fold line. During the rigors of sanding, the weakened fold line may tear, thereby resulting in premature failure of the sandpaper.

SUMMARY

A sheet of sandpaper includes a backing layer having opposed first and second major sides, an adhesive make coat on the second major side, abrasive particles at least partially embedded in the make coat, thereby defining an abrasive surface, and an exposed fibrous non-slip layer on the first major side. Methods of making and using such sandpaper are also provided.

In one aspect, disclosed herein is a sheet of sandpaper, comprising: a flexible backing layer having opposed first and second major sides; an adhesive make coat on the second major side of the backing layer; abrasive particles at least partially embedded in the make coat, thereby defining an abrasive surface; and an exposed fibrous non-slip layer on the first major side of the backing layer.

In another aspect, disclosed herein is a method of making a sheet of sandpaper having a fibrous non-slip layer on the first major side thereof, comprising the steps of: providing a flexible backing layer having opposed first and second major sides; coating an adhesive make coat on the second major side of the backing layer; at least partially embedding abrasive particles in the make coat, thereby forming an abrasive surface; and, forming an exposed fibrous non-slip layer on the first major side of the backing layer.

BRIEF DESCRIPTION OF THE DRAWINGS

The present invention will be further described with reference to the accompanying drawings, in which.

DETAILED DESCRIPTION

Figure 1:
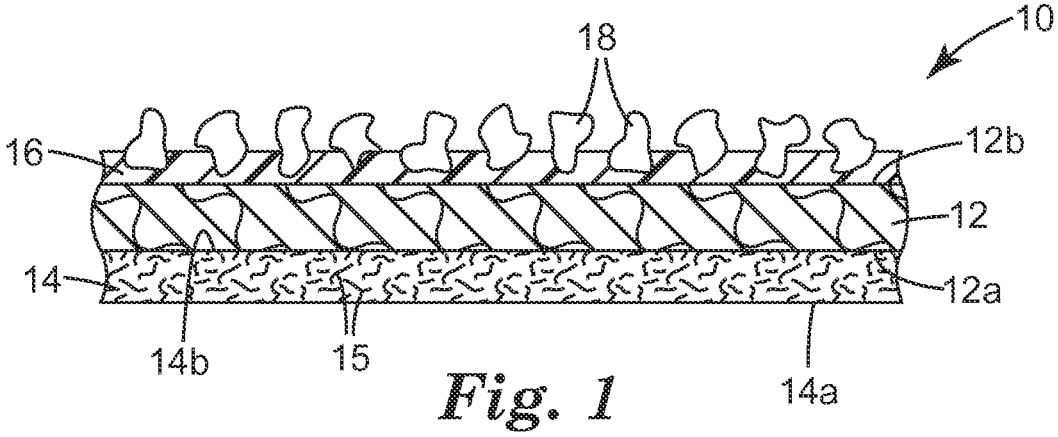
FIG. 1 is a cross sectional view of an exemplary sheet of sandpaper with a fibrous non-slip layer as disclosed herein.

Referring now to the drawings, FIG. 1 shows in exemplary generic representation a flexible sheet-like abrasive article 10, such as a sheet of sandpaper. As used herein, the expression "sheet-like" refers generally to the broad, thin, flexible nature of abrasive article 10. Article 10 comprises a flexible backing layer 12 having opposed first and second major sides respectively bearing first and second major surfaces 12*a* and 12*b*, and comprises an exposed fibrous non-slip layer 14 on the first major side of backing layer 12, an adhesive make coat layer 16 on the second side of the backing layer 12, and a plurality of abrasive particles 18 at least partially embedded in the make coat layer 16. (The terms first major side (and e.g. first major surface thereof) will in general denote the side and surface of backing 12 bearing fibrous non-slip layer 14 (i.e., the side opposite abrasive particles 18), and the terms second major side (and e.g. second major surface thereof) will in general denote the side and surface of backing 12 thereof comprising abrasive particles 18.) The condition that fibrous non-slip layer 14 is "on" the first major side of backing layer 12 (as well as herein-described actions such as laminating, depositing, etc. fibers (in any form) "on" or "onto" the first major side of backing layer 12) encompasses both cases in which fibrous layer 14 (e.g., major surface 14*b* of layer 14) is in direct contact with major surface 12*a* of the first major side of layer 12, and cases in which layer 14 is separated from direct contact with major surface 12*a*, e.g. by one or more adhesion-enhancing layers and/or support layers as disclosed later herein.

Fibrous non-slip layer 14 is comprised of a multiplicity of fibers 15, and comprises outward-facing exposed major surface 14*a*, and oppositely-facing major surface 14*b* (noting that major surfaces 14*a* and 14*b* may be provided collectively by fiber surfaces and thus may not correspond to strictly continuous planar surfaces). At least some portions (e.g., surfaces) of some fibers 15 (e.g., at least those fiber surface portions providing outward-facing exposed surface 14*a* of layer 14) collectively provide layer 14 with a non-slip property as disclosed herein.

Figure 2:
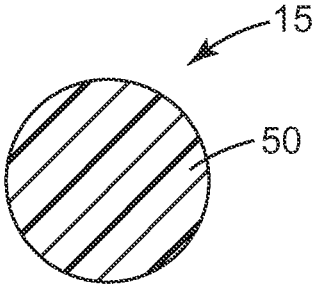
FIG. 2 is a cross sectional view of an exemplary fiber of a fibrous non-slip layer.
Figure 3:
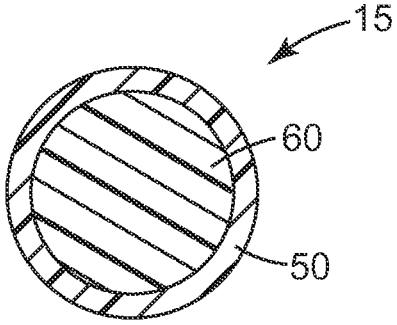
FIG. 3 is a cross sectional view of another exemplary fiber of a fibrous non-slip layer.
Figure 4:
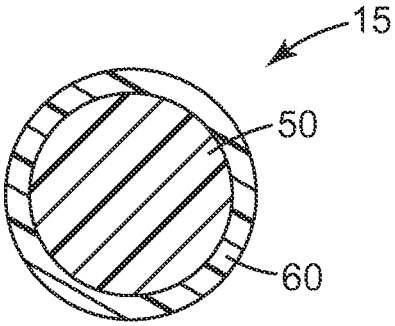
FIG. 4 is a cross sectional view of another exemplary fiber of a fibrous non-slip layer.
Figure 5:
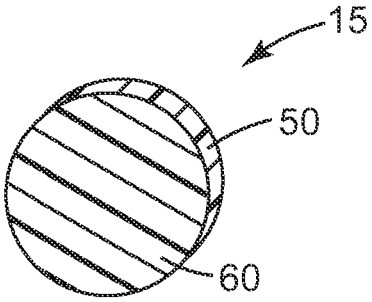
FIG. 5 is a cross sectional view of another exemplary fiber of a fibrous non-slip layer.

In various embodiments, at least some fibers 15 may be generally completely comprised of material 50 which imparts a non-slip property, as shown in FIG. 2. In other embodiments, at least some fibers may be multicomponent fibers (meaning that they may comprise at least two compositionally-different domains), comprising material 50 which imparts a non-slip property, and at least one other material 60 which may be present for some other purpose. For example, material 60 may provide bonding properties, may provide mechanical strength and/or durability, and so on. Such multicomponent fibers may be multilayer fibers (sometimes termed "conjugate" fibers), for example comprising a core of other material 60 and a sheath of non-slip-imparting material 50, as shown in exemplary embodiment in FIG. 3. Alternatively, they may comprise a core of non-slip-imparting material 50 and a sheath of other material 60, as shown in exemplary embodiment in FIG. 4. In this second case, it may be useful to process or treat such fibers so as to expose at least a portion of non-slip-imparting material 50, e.g. by fracturing the fibers, by melting at least a portion of other material 60 (e.g. during a melt-bonding process), and so. In any of the above embodiments, other fibers may be present for other purposes, which do not necessarily contain any non-slip-imparting material 50. In some embodiments, non-slip-imparting material 50 may comprise a material that is coated onto at least a portion of at least some fibers 15, as shown in exemplary embodiment in FIG. 5.

In general, fibrous non-slip layer 14 may be comprised of fibers made and/or arranged in any suitable manner. For example, fibrous layer 14 may comprise a nonwoven fibrous layer such as a spunbonded web, a meltblown web, a carded web, an air-laid web, or a wet-laid web; a woven web; a knitted cloth; and so on. In various embodiments, at least material 50 of fibers 15 may have a glass transition temperature of at least about −80 degrees Celsius (° C.), at least about −70° C., and at least about −65° C., and a glass transition temperature of no greater than about −5° C., no greater than about −15° C., and no greater than about −25° C. In some embodiments, fibers 15 may be continuous, meaning that they are formed into fibrous layer 14 in generally the same form in which they were made in a fiber-formation process (e.g., melt-blowing, melt-spinning, solvent-spinning, etc.) without having been chopped to a shorter length. In alternative embodiments, fibers 15 may be chopped fibers (e.g. staple fibers), and in various embodiments may have a length of less than about 10 mm, 5 mm, 2 mm, or 1 mm, prior to, and after, being formed into fibrous layer 14. In some embodiments, at least some of fibers 15 may be bonded to each other at points of fiber intersection (i.e., points of contact, near-contact, or close proximity). Such bonding may be direct between fibers (e.g., by melt-bonding surfaces of fibers together, e.g. by such processes as heated calendering, through-air bonding, or the like). Or, such bonding may be indirect (e.g., by the use of binders, whether particulate, liquid, fibrous, or the like). Fibers 15 may also be mechanically entangled (e.g., by needlepunching, hydroentangling, or the like). In some embodiments, fibrous layer 14 may comprise a surface layer of heavily melt-bonded and densified fibers (as achieved e.g. by passing the fibrous layer over a heated roll, and as may be desired to improve the mechanical strength of the fibrous layer).

In the case in which fibers 15 are bonded to each other, entangled, etc., it may not be necessary that all of fibers 15 are individually bonded to backing 12 or an adhesion-enhancing layer thereof. For example, if fibrous layer 14 is formed by the lamination of a self-supporting fibrous web (meaning a web containing sufficient fiber-to-fiber bonds or entanglements to be handled in roll-to-roll processing) to backing layer 12 or to an adhesion-enhancing layer thereof, it may only be necessary to bond fibrous layer 14 at certain locations (e.g., by point-bonding as achieved by calendering, by the use of a bonding adhesive only applied in certain discontinuous locations, and so on).

In other embodiments, it may be desirable that generally all of fibers 15 be individually bonded to backing layer 12 or an adhesion-enhancing layer thereof. This may be convenient e.g. in the case that fibrous layer 14 is formed not by lamination of a (pre-existing) self-supporting fibrous web, but rather by depositing individual fibers 15 (that are not bonded to each other) onto backing layer 12 or an adhesion-enhancing layer thereof, as disclosed elsewhere herein.

Fibrous non-slip layer 14 is an exposed layer. By this is meant that outer surface 14*a* of fibrous non-slip layer 14 is an exposed surface that makes up at least the majority of the outermost surface of the first major side of abrasive article 10 when article 10 is in use. That is, the majority of outer surface 14*a* of article 10, as article 10 is provided to an end user, is not covered, buried, or obscured by any other layer, except for, optionally, such items as labels, stickers, price tags, temporary protective sheets or liners, or the like, which are not permanently attached to fibrous non-slip layer 14 and which may be removed if desired prior to use of article 10. Thus, a fibrous layer which bears a further-outward permanently attached layer (e.g., a hook layer, a loop layer, a mechanical fastening layer, a pressure-sensitive adhesive layer, etc.) over a majority of its area, by definition does not comprise an exposed fibrous non-slip layer irrespective of the composition and/or properties of the fibrous layer. In various embodiments, at least about 50%, at least about 75%, or at least about 90%, of outer surface 14*a* of non-slip layer 14 is an exposed surface. In some embodiments, the entirety of outer surface 14*a* of fibrous non-slip layer consists of an exposed surface.

As used herein, "non-slip" layers refer to layers that increase the coefficient of friction of the backing layer surface to which the non-slip material is applied. That is, if the surface of a backing layer on which a fibrous non-slip layer is provided has a coefficient of friction of "x" prior to when the non-slip layer is provided thereon, and the fibrous layer provides a surface that has a coefficient of friction that is greater than "x", then the layer is a "non-slip" layer. Or stated another way, if the fibrous layer tends to increase the coefficient of friction of the backing surface to which it is applied, then the fibrous layer qualifies as a "non-slip" layer.

In one embodiment, the fibrous non-slip layer 14 has an average peak static coefficient of friction of at least about 1.0 gram, at least about 1.25 grams, or at least about 1.5 grams when measured according to ASTM D 1894-08 (Standard Test Method for Static and Kinetic Coefficients of Friction of Plastic Film and Sheeting) at 23° C. using an IMASS slip/peel tester (SP2000, commercially available from Instrumentors Inc., Strongsville, Ohio), and/or an average kinetic coefficient of friction of at least about 0.75 grams, at least about 1 gram, or at least about 1.25 grams.

In various embodiments, fibrous non-slip layer 14 outer surface 14*a* may have no tack, or may have a low level of tack. If the non-slip layer is tacky, it may be desirable that the tack be kept to a low level. By low level of tack, it is meant that the non-slip layer has an average tack level, as measured by ASTM D2979-88 (Standard Test Method for Tack of Pressure-Sensitive Adhesives Using an Inverted Probe Machine) using a ten (10) second dwell time, and a probe removal speed of one (1) cm/s, of no greater than about 350 grams. A fibrous non-slip layer as defined and disclosed herein (even if it comprises a low level of tack, as opposed to no tack), comprises a sufficiently low level of tack that by definition it may not be equated with conventional pressure-sensitive adhesives e.g. as may sometimes be used to attach sandpaper to sanding blocks, vibrating or orbital sanders, and the like. In various embodiments, fibrous non-slip layer 14 has an average tack level, as measured by ASTM D2979-88 (Standard Test Method for Tack of Pressure-Sensitive Adhesives Using an Inverted Probe Machine) using a ten (10) second dwell time, and a probe removal speed of one (1) cm/s, of no greater than about 200 grams, no greater than about 250 grams, or no greater than about 300 grams.

In some embodiments, fibrous non-slip layer 14 may comprise an adhesion to itself that is less than the cohesive strength of the non-slip layer itself, and further may have an adhesion to itself that is less than the "two-bond" adhesive strength. As is known to those skilled in the art, the "two-bond" adhesive strength is the adhesive strength between non-slip layer 14 and backing layer 12 to which the fibrous non-slip layer is applied. Thus, when non-slip layer 14 is folded over onto itself, the areas of the surface of the non-slip layer that come into contact with each other can be released from each other without experiencing cohesive failure of the non-slip layers, and without having any portion of fibrous non-slip layer 14 detach from backing layer 12.

In some embodiments, the non-slip layer provides a surface that may be repeatably bonded to itself. In another somewhat related aspect, non-slip layer 14 may be repositionable. As used herein, "repositionable" refers to a non-slip layer that allows repeated application, removal, and reapplication to and from itself or a surface without damage to the non-slip layer or the surface.

In addition, it is desirable that the adhesion of fibrous non-slip layer 14 to itself not build significantly over time. As such, if abrasive article 10 is folded over onto itself such that areas of the surface of the non-slip layer come into contact with each other, abrasive article 10 may later be readily unfolded by separating the contacted surface areas of fibrous non-slip layer 14 without damaging non-slip layer 14 or backing layer 12.

In various embodiments, fibrous non-slip layer 14 may comprise a thickness (e.g., an average thickness as measured in several locations) of at least about 10 microns, at least about 15 microns, at least about 20 microns, or at least about 25 microns. In further embodiments, fibrous non-slip layer 14 may comprise a thickness of at most about 2000 microns, at most about 1000 microns, at most about 500 microns, or at most about 100 microns.

In various embodiments, fibrous non-slip layer 14 may comprise an areal density (e.g., an average as measured in several locations) of at least about 10 grams per square meter, at least about 15 grams per square meter, at least about 20 grams per square meter, or at least about 25 grams per square meter. In further embodiments, fibrous non-slip layer 14 may comprise an areal density of at most about 200 grams per square meter, at most about 100 grams per square meter, at most about 60 grams per square meter, or at most about 25 grams per square meter. In various embodiments, the fibers 15 of fibrous non-slip layer 14 may comprise a volumetric density of at least about 0.9 grams/cc, at least about 0.95 grams/cc, or at least about 1.0 grams/cc.

Fibrous non-slip layer 14 of an abrasive article 10 (e.g. sandpaper), as disclosed herein, by definition does not encompass a so-called loop portion of a conventional hook-and-loop fastening system, nor a so-called hook portion of such a fastening system. Further, it does not encompass a sponge or foam layer, whether open or closed cell (e.g., of a so-called sanding sponge).

In some embodiments, at least some of the materials of fibers 15 (e.g., at least non-slip-imparting material 50) may comprise at least one base resin. A base resin may comprise any suitable polymeric material that provides mechanical integrity and toughness to the fibers of the fibrous non-slip layer, but that may not necessarily (in the absence of the tackifying resin) supply the desired non-slip properties disclosed herein. Suitable base resins may include, for example: natural and synthetic rubbers such as synthetic polyisoprene, butyl rubbers, polybutadiene, styrene-butadiene rubber (SBR), carboxylated styrene-butadiene rubber, block copolymers such as Kraton rubber, polystyrene-polyisoprene-polystyrene (SIS) rubber, styrene-butadiene-styrene (SBS) rubber, nitrile rubber (Buna-N rubbers), hydrogenated nitrile rubbers, acrylonitrile-butadiene rubber (NBR), chloroprene rubber, polychloroprene, neoprene, EPM rubber (ethylene propylene rubber), EPDM rubber (ethylene propylene diene rubber), ethylene-propylene-butylene terpolymers, acrylic rubber, polyacrylic rubber, silicone rubber; copolymers such as ethylene-vinyl acetate (EVA) copolymers, ethylene-(meth) acrylate copolymers, ethylene-vinyl acetate-maleic anhydride and/or ethylene-(meth)acrylate-maleic anhydride terpolymers; and other polymeric materials such as polyvinyl acetates, grafted polyvinyl acetates or EVA copolymers, polyamides, polyesters, thermoplastic elastomers, thermoplastic vulcanizates such as Santoprene thermoplastic rubber, thermoplastic polyurethanes, and thermoplastic olefins and amorphous polyolefins.

In some embodiments, the at least one base resin may comprise a poly(vinyl ether) polymer, e.g. an amorphous poly(alkyl vinyl ether) polymer such as amorphous poly(methyl vinyl ether). In some embodiments, the at least one base resin may comprise a polyolefin, e.g. a polyethylene, polypropylene, polybutene, and/or copolymers (including terpolymers) thereof. In certain embodiments, such a polyolefin may comprise a grafted polyolefin, e.g. a polyethylene with a saponification number of at least three, and which may be grafted e.g. with polycarboxylic acids, anyhydrides, esters thereof, or the like. In certain other embodiments, such a polyolefin may comprise a metallocene (catalyzed) polyolefin, for example a functionalized metallocene polyethylene polymer or copolymer. Such polymers or copolymers may be functionalized e.g. with acids such as acrylic acid, acetates, sulfonates, maleic anhydrides, or the like.

In some embodiments, the base resin may comprise an amorphous polymer. By amorphous is meant a polymer that displays essentially no crystallinity, as evidenced by no, or at most a very weak (i.e., barely discernible), melting point(s) on a Differential Scanning calorimetry curve, as will be appreciated by those of ordinary skill. In various specific embodiments, an amorphous polymer may comprise an amorphous hydrocarbon polymer or copolymer (such as, e.g., polyolefin polymers and/or copolymers containing ethylene, propylene, higher alkenes, and/or copolymers thereof, polymers and/or copolymers of higher order dienes, polymers and/or copolymers of poly-alpha olefins, etc.); or, an amorphous heteroatom polymer or copolymer (such as, e.g. polyolefin-poly(meth)acrylate copolymers, polyolefin-EVA copolymers, poly(vinyl ether) polymers and/or copolymers, and the like). In some embodiments, the amorphous polymer may comprise atactic polypropylene and/or copolymers thereof. In some embodiments, the amorphous polymer is an aliphatic polymer (i.e., not comprising aromatic units). In some embodiments, the base resin consists essentially of an amorphous polymer or copolymer or of mixtures of amorphous polymers or copolymers. In some embodiments, the amorphous polymer may comprise a poly-alpha-olefin hydrocarbon copolymer (e.g., terpolymer) containing propyl, ethyl, and butyl monomer units (e.g., obtained by the copolymerization of propylene, ethylene, and 1-butene). In particular embodiments, the amorphous polymer may comprise, or may consist essentially of, a propylene-rich poly-alpha-olefin polymer, meaning a copolymer containing at least about 70 mole % of propylene-derived monomer units and from about 5 mole % to about 15 mole % of 1-butene-derived monomer units, with the balance being chosen from any other suitable monomer units, e.g. ethylene.

The above list is meant to be representative, not exhaustive. Blends, mixtures, etc. of any of the above base resins may be used if desired.

In some embodiments, at least some of the materials of fibers 15 (e.g., at least non-slip-imparting material 50) may comprise a tackifying resin. A tackifying resin may comprise any material (e.g., polymeric material) that may not necessarily comprise acceptable mechanical integrity by itself, but that when present at an effective amount along with a base resin, supplies the combination of resins with the desired non-slip properties disclosed herein. By an effective amount of tackifying resin is meant an amount sufficient to satisfactorily provide the non-slip properties disclosed herein (e.g., whether measured quantitatively by way of a coefficient of friction and/or tack test as disclosed earlier herein, or qualitatively by way of manually handling and sanding with an abrasive article comprising the non-slip layer). By an effective amount is further meant an amount that is lower than a threshold level that would cause the non-slip layer to be a conventional pressure-sensitive adhesive.

Suitable tackifying resins for non-slip layer 14 may include, for example: polymeric terpenes, hetero-functional terpenes, coumarone-indene resins, rosin acids, esters of rosin acids, disproportionated rosin acid esters, hydrogenated rosin acids, $C_5$ aliphatic resins, $C_9$ aromatics, $C_9$ hydrogenated aromatic resins, $C_5/C_9$ aliphatic/aromatic resins, dicyclopentadiene resins, hydrogenated pinene polymers or copolymers, hydrogenated hydrocarbon resins arising from $C_5/C_9$ and dicyclopentadiene precursors, hydrogenated styrene monomer resins, alpha-methyl styrene resins, hydrogenated mixed aromatic tackifying resins, aliphatic/aromatic hydrocarbon liquid tackifying resins; napthenic oils, mineral oils, alkyl phenolic tackifying resins, and the like. Additionally potentially suitable tackifying resins may include, for example: alpha-methylstyrene; copolymers of alpha-methylstyrene and styrene; hydrogenated cyclopentadienes, a rosin or a terpene resin of the alpha-pinene, beta-pinene and d-limonene types; wood rosins or gum rosins; rosin esters derived from either gum or wood rosin, such as glycerol esters (ester gums), pentaerythritol esters, hydrogenated, polymerized or disproportionated gum or wood rosins; polyhydric alcohol derivatives of hydrogenated rosin, such as glycerol derivatives or polyhydroalcohol derivatives of polymerized rosins; e.g. ethylene glycol ester, glycerol esters, oxidized rosins, hydrogenated oxidized rosin esters of oxidized rosin and the like. Still other potentially suitable tackifying resins may include e.g. hydrocarbon resins such as polyterpenes, synthetic polyterpenes, and those materials obtained from the polymerization of olefins and diolefins (e.g., the aliphatic olefin derived tackifying resins available from the Sartomer Company of Exton, Pa. under the trade designation Wingtack). Still other potentially suitable tackifying resins include e.g. terpene polymers such as the polymeric, resinous materials obtained by polymerization and/or copolymerization of terpene hydrocarbons such as the alicyclic, monocyclic, and bicyclic monoterpenes and their mixtures, including allo-ocimene, carene, isomerized pinene, pinene, dipentene, terpinene, terpinolene, limonene, turpentine, a terpene cut or fraction, and various other terpenes. In some embodiments, the tackifying resin(s) is a hydrocarbon material; in particular embodiments, the tackifying resin(s) is an aliphatic hydrocarbon material. Such materials may be e.g. branched hydrocarbon polymers.

This list is meant to be representative, not exhaustive. Blends, mixtures, etc., of any or all of the above-listed tackifying resins can be used.

Fibrous non-slip layer 14 may optionally comprise at least one wax, by which is meant a relatively low molecular weight material that may modify or enhance various properties of the fibrous non-slip layer. Any suitable natural (e.g., animal, vegetable, mineral, or petroleum based) or synthetic wax may be used. Such waxes may include e.g. hydrocarbon waxes, paraffin waxes, microcrystalline waxes, fatty amide waxes, hydroxy stearamide waxes, vinyl acetate-modified waxes, maleic anhydride-modified waxes, high density low molecular weight (e.g., less than approximately 2500) polyethylene waxes, and the like.

Any other desirable ingredients may be included in fibrous non-slip layer 14 as long as they do not unacceptably affect the non-slip property. Such additives may include e.g. processing aids, extrusion aids, antioxidants, wetting agents, UV stabilizers, nucleating agents, plasticizers, pigments, dyes, fillers, and so on.

In some embodiments, fibrous non-slip layer 14 consists essentially of at least one base resin, at least one tackifying resin, and at least one wax along with optional minor quantities of additives such as processing aids, antioxidants and the like.

In some embodiments, fibrous non-slip layer 14 (e.g., major surface 14*b* of layer 14), may be in direct contact with first major surface 12*a* of backing layer 12 with no layer(s) therebetween, as shown in FIG. 1. (In such a case, at least some fibers 15 of fibrous non-slip layer 14 may be directly bonded to first major surface 12*a*.) In other embodiments, one or more intermediate layers of material may be present between at least a portion of backing layer 12 and at least a portion of fibrous non-slip layer 14, for various purposes. Such intermediate layers may comprise e.g. support layers and/or adhesion-enhancing layers, as disclosed elsewhere herein. In various embodiments, such intermediate layers may comprise an average thickness of less than about 200 microns, less than about 100 microns, less than about 50 microns, less than about 25 microns, or less than about 10 microns, and may be applied by any suitable method including e.g. by coating, vapor deposition, etc. Such layers may be continuous or discontinuous. In some embodiments such intermediate layers may be comprised of dense materials (e.g., lacking porosity).

An embodiment in which fibrous non-slip layer 14 is bonded directly to backing 12 is shown in exemplary illustration in FIG. 1. In such case, at least a portion of at least some fibers 15 may comprise a composition capable of bonding, e.g. melt-bonding, to major surface 12*a* of backing layer 12. For example, non-slip layer 14 may comprise e.g. a heat-bondable composition, e.g. may be a thermoactivatable non-woven web. Thermoactivatable webs are generally known, and may include e.g. products available from ProTechnics, Cernay, France, under the trade name Texiron. Any thermo-activatable web may be used as fibrous layer 14 (whether directly attached to backing layer 12, or in any other of the embodiments disclosed herein) as long as it satisfies the conditions prescribed earlier herein (i.e., that fibrous layer 14 possesses suitable non-slip properties). Such webs may comprise e.g. fibers, and/or portions of fibers, that provide non-slip-imparting properties, and other fibers, and/or other portions of fibers, that provide the desired bonding ability. Such webs may thus comprise fiber mixtures and/or multicomponent fibers. Fibers of composition suitable for direct bonding to backing 12 may, if desired, be deposited thereon in the form of individual unbonded fibers or as an unbonded-fiber mat (rather than being deposited as a preformed web), as disclosed elsewhere herein.

Figure 6:
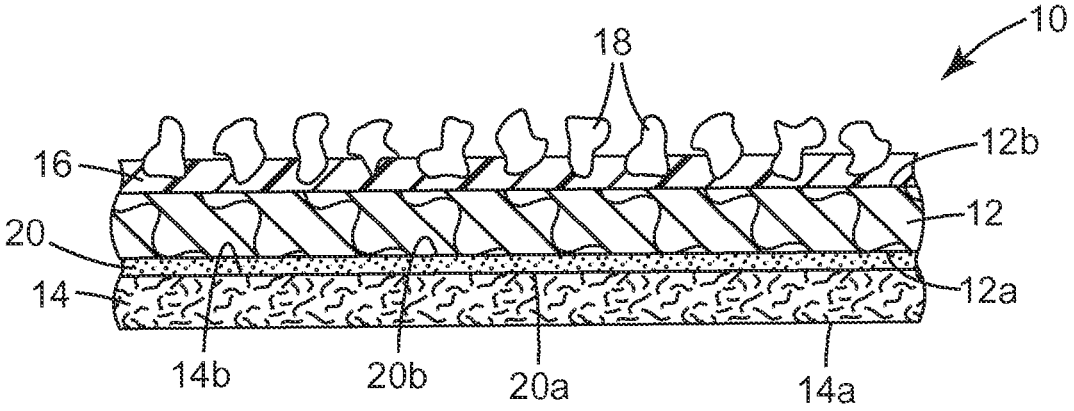
FIG. 6 is a cross sectional view of another exemplary sheet of sandpaper.
Figure 7:
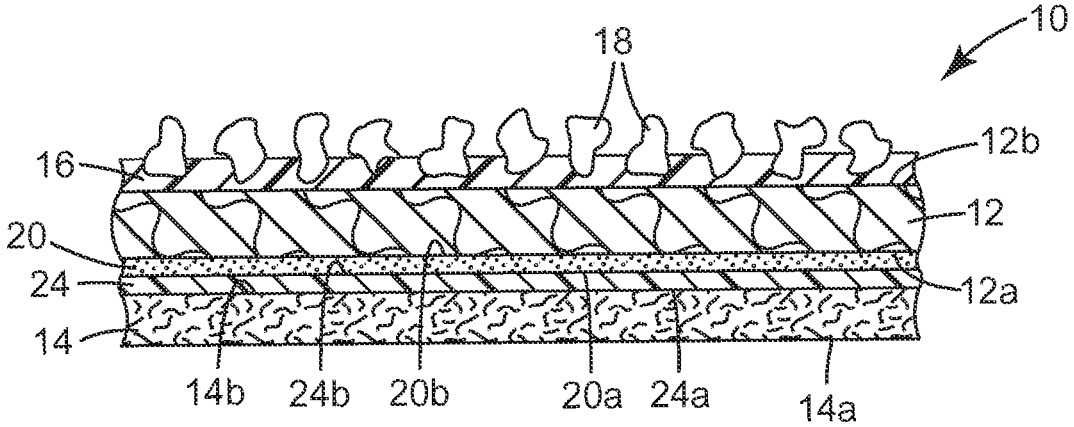
FIG. 7 is a cross sectional view of another exemplary sheet of sandpaper.

Embodiments in which one or more intermediate layers of other material are present between at least a portion of fibrous non-slip layer 14 and a portion of backing 12 are shown in exemplary illustration in FIGS. 6 and 7. In particular embodiments, such a layer or layers are present between the entirety of non-slip layer 14 and backing 12. In some embodiments, such intermediate layers may comprise adhesion-enhancing layers, which category broadly encompasses any layer which provides, facilitates, promotes, etc., the bonding of non-slip layer 14 to backing 12.

In a particular exemplary embodiment depicted in FIG. 6, adhesion-enhancing layer 20 may comprise an adhesive layer that is capable of bonding both to major surface 14*b* of non-slip layer 14, and to major surface 12*a* of backing 12. Such an adhesive layer may be comprised of any suitable adhesive composition, delivered to article 10 by any suitable mechanism. In some embodiments, adhesive layer 20 may be a laminating adhesive, e.g. a pressure-sensitive adhesive. In specific embodiments, adhesive layer 20 may comprise a hot-melt adhesive composition which may be deposited onto the backside of backing 12 in a heated (flowable) state, with fibrous non-slip layer 14 being brought into contact with an exposed surface of adhesive layer 20 e.g. while layer 20 is still in a heated state in which it is capable of bonding to fibrous layer 14. In such manner, fibrous non-slip layer 14 can be laminated to backing 12. In other embodiments, adhesive layer 20 may comprise a pre-formed layer (e.g., film or web) web which may be placed in between backing 12 and non-slip layer 14 and heated so as to activate or promote bonding between the major surfaces of adhesive layer 20 and the major surfaces of backing 12 and non-slip layer 20. Various thermoactivatable webs may be useful for such purposes, including e.g. products available from ProTechnics, Cernay, France, under the trade name Texiron (noting that in this particular configuration a thermoactivatable web, not serving as a fibrous non-slip layer itself, may not necessarily need to satisfy any particular non-slip criterion). It should be noted that adhesive layer 20 does not necessarily need to be a continuous layer, and can comprise such adhesive materials as may be discontinuously deposited (e.g., sprayed) onto the first major side of backing 12.

In further detail, adhesive layer 20 may comprise e.g. any of a pressure-sensitive adhesive, a hot-melt adhesive, a hardenable adhesive, a drying adhesive, and a photohardenable adhesive (recognizing that some adhesive compositions may fall into more than one of these categories). By a hardenable adhesive is meant an adhesive that solidifies by a chemical reaction (with or without liberation of small molecules), e.g. a moisture-cure silicone, an epoxy, and the like. By a drying adhesive is mean an adhesive that solidifies by the loss of a solvent and/or water, e.g. rubber cement, a water-based glue, and the like. By a photohardenable adhesive is meant one whose hardening is initiated or promoted by radiation (such as visible light, UV radiation, etc.), e.g. the well-known UV-curable adhesives and the like.

In other embodiments, adhesion-enhancing layer 20 may comprise an adhesion-promoting layer, e.g. a tie layer, primer layer, or the like, that is deposited, coated, or otherwise formed atop major surface 12*a* of backing 12. The composition of such an adhesion-promoting layer may be chosen in view of the composition of fibrous non-slip layer 14 which is desired to be laminated to backing 12. For example, if non-slip layer 14 comprises at least some polyolefin components, a primer or tie layer may be disposed (e.g. coated) onto major surface 12*a* of backing 12, that promotes bonding to such polyolefin components. More than one adhesion-enhancing layer, of any desired type, may be used, e.g. in combination. For example, upon selecting a laminating adhesive that is well suited to bond to a particular fibrous non-slip layer 14, a tie layer may be coated onto major surface 12*a* of backing 12 that is particularly well suited to be bonded by that same laminating adhesive. It should be noted that, as with an adhesive layer, an adhesion-promoting layer may or may not be a continuous layer.

As illustrated in exemplary manner in FIG. 7, one or more support layers 24 may be provided in between at least a portion of fibrous non-slip layer 14 and a portion of backing 12. Such a support layer may be particularly useful in a case in which fibrous non-slip layer 14 is sufficiently thin, and/or comprises sufficiently delicate physical properties, as to make non-slip layer 14 difficult to handle as a free-standing film. In such circumstances, non-slip layer 14 may be provided on support layer 24 which becomes part of the structure of the resulting article 10. As such, a support layer 24 is defined herein as a layer upon which fibrous non-slip layer 14 is already bonded to form a multilayer structure prior to layer 14 being laminated onto the first major side of backing 12.

Fibrous non-slip layer 14 may be provided on (e.g., attached to) support layer 24 by any suitable method, including any deposition method disclosed herein (e.g., deposition of fibers whether individually or in mat or web form), and likewise including any bonding method disclosed herein (e.g., melt-bonding, adhesive bonding, bonding by use of an adhesion-enhancing layer, etc.) In exemplary embodiments of the general type depicted in FIG. 7, an adhesion-enhancing layer 20 (e.g., a laminating adhesive) may be used to bond support layer 24 to backing 12. In some embodiments, support layer 24 may also function as an adhesion-enhancing layer, in which case a separate adhesion-enhancing layer 20 may not necessarily be needed. If a support layer 24 is used, its composition may be chosen so that non-slip layer 14 may be adhered satisfactorily to major surface 24*a* of support layer 24. If desired, major surface 24*a* may be treated, and/or a tie layer applied, so as to enhance the ability of non-slip layer 14 to remain adhered to support layer 24. Likewise, if an adhesion-enhancing layer 20 is used to bond support layer 24 to the first major side of backing layer 12, surface 24*b* of support layer 24 may be treated so as to enhance its ability to be bonded by adhesion-enhancing layer 20.

Support layer 24 may be comprised of any suitable web, encompassing both dense materials (e.g., dense films) and discontinuous webs (e.g. nonwovens, nettings, scrims and the like), that has adequate physical properties to render a multilayer combination of support layer 24 and non-slip layer 14 able to be handled so as to be laminated to backing 12. For example, support layer 24 may comprise a film of polyester, polyethylene, polypropylene (e.g., oriented or biaxially oriented polypropylene), cellophane, or the like. The thickness of support layer 24 may be likewise chosen to provide sufficient handleability to the multilayer combination of support layer 24, and non-slip layer 14, while preserving acceptable flexibility of abrasive article 10. Thus, for example, support layer 24 may comprise e.g. a film with thickness less than about 12 microns, about 25 microns, about 38 microns, about 50 microns, or the like. If support layer 24 comprises a dense film, non-slip layer 14 may not necessarily penetrate significantly thereinto. In other embodiments, a support layer may comprise an at least partially penetrable web. In various embodiments at least partially penetrable web support layer may comprise any fibrous material including e.g. a nonwoven fibrous layer such as a spunbonded web, a meltblown web, or a carded web; a woven web; a knitted cloth; a polymeric netting; or the like.

In summary, non-slip fibrous layer 14 may be provided on the first major side of backing 12, by use of any convenient combination of the herein-disclosed optional adhesion-enhancing layers (whether adhesive layers or adhesion-promoting layers, or both), and/or optional support layers. In some embodiments, the only layer present between fibrous non-slip layer 14 and backing 12 is an adhesive layer. In other embodiments, exactly one adhesive layer and exactly one adhesion-promoting tie layer or primer layer are present between fibrous non-slip layer and backing 12. In other embodiments, exactly one support layer and exactly one adhesive layer are present between fibrous non-slip layer 14 and backing 12. In still other embodiments, exactly one support layer, exactly one adhesive layer, and exactly one adhesion-promoting tie layer or primer layer, are present between fibrous non-slip layer 14 and backing 12.

Suitable materials for flexible backing layer 12 may include any of the materials commonly used to make sandpaper including, for example, paper, cloths (cotton, polyester, rayon), polymeric films such as thermoplastic films, foams, and laminates thereof. The backing layer 12 will have sufficient strength for handling during processing, sufficient strength to be used for the intended end use application, and the ability to have non-slip layer 14 provided on its first major surface, and make coat 16 applied to its second major surface.

In the illustrated embodiment, backing layer 12 is formed of paper. Paper is a desirable material for backing layer 12 because it is readily available and is typically low in cost. Conventional sandpaper, however, which has a paper backing layer, has limited durability, and has a smooth slippery surface that makes conventional sandpaper difficult to move over a work surface and, therefore, makes sanding difficult. Paper backings are available in various weights, which are usually designated using letters ranging from "A" to "F". The letter "A" is used to designate the lightest weight papers, and the letter "F" is used to designate the heaviest weight papers. In the illustrated embodiment of FIG. 1, backing layer 12 is continuous. That is, backing layer 12 does not contain holes, openings, slits, voids, or channels extending there through in the Z-direction (i.e. the thickness or height dimension) that are larger than the randomly formed spaces between the material itself when it is made. The backing may also contain openings (i.e. be perforated), or contain slits. Backing layer 12 is also generally non-extensible. Non-extensible refers to a material having an elongation at break of typically no greater than about 25%, no greater than about 10%, or no greater than about 5%.

In certain embodiments, e.g. when backing layer 12 is formed of paper, backing layer 12 may be relatively thin, and typically has a thickness of no greater than about 1.5 mm, no greater than about 1 mm, or no greater than about 0.75 mm. In such embodiments, the backing layer 12 is generally not resilient. The backing layer 12 may be porous or non-porous. In some embodiments, backing layer 12 consists of a single layer.

In some embodiments, backing layer 12 of sandpaper 10 may be formed of a cloth material or film, such as a polymeric film. Cloth materials may be desirable because they are generally tear resistant and are generally more durable than paper and film materials. In addition, cloth backings tolerate repeated bending and flexing during use. Cloth backings are generally formed of woven cotton or synthetic yarns that are treated to make them suitable for use as a coated abrasive backing As is the case with paper backings, cloth backings are available in various weights, which are usually designated using a letter ranging from "J" to "M" with the letter "J" designating the lightest weight cloth, and the letter "M" designating the heaviest weight cloths.

Suitable film materials for the backing layer 12 may include polymeric films, including primed films, such as polyolefin film (e.g., polypropylene including biaxially oriented polypropylene, polyester film, polyamide film, cellulose ester film).

In various embodiments, backing layer 12 (as well as any other layers of sandpaper 10) may be comprised of specially chosen materials, and/or may be treated, so as to be easily foldable and/or tearable, e.g. hand-tearable. For example, one or more lines of weakness (e.g., a line of partial- or through-perforations) may be provided to facilitate easy folding and/or tearing by hand.

In general, any adhesive make coat 16 may be used to adhere the abrasive particles 18 to the backing layer 12. "Make coat" refers to the layer of hardened resin over the backing layer 12 of the sandpaper 10. Suitable materials for the adhesive make coat 16 include, for example, phenolic resins, aminoplast resins having pendant $\alpha,\beta$-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof. The make coat 16 may be coated onto the backing layer 12 by any conventional technique, such as knife layer, spray layer, roll layer, rotogravure layer, curtain layer, and the like. The sandpaper 10 may also include an optional size coat (not shown). The make coat 16 and/or an optional size coat may contain optional additives, such as fillers, fibers, lubricants, grinding aids, wetting agents, thickening agents, anti-loading agents, surfactants, pigments, dyes, coupling agents, photo-initiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. The amounts of these materials are selected to provide the properties desired, as is known to those skilled in the art.

In some embodiments, adhesive make coat 16 consists of a single layer that is in direct contact with surface 12*b* of backing layer 12. In such embodiments, the combination of backing layer 12 and adhesive make coat 16 does not encompass configurations involving three or more layers, e.g. a backing layer bearing a binder layer thereupon, which binder layer bears an adhesive layer thereupon.

In general, abrasive particles 18 of any suitable size (e.g., diameter or equivalent diameter in the event of substantially nonspherical particles) may be used with this invention. In some embodiments, abrasive particles 18 may have a FEPA P grade, as outlined by the Federation of European Producers of Abrasives and as tested in accordance with the ISO 6344 standard, of P100 or lower (with a lower grade corresponding to larger particles). In various embodiments, the abrasive particles and the abrasive article comprising the abrasive particles, may comprise an FEPA grade of P80, of P60, or of P40.

Suitable abrasive particles may include, for example, fused aluminum oxide, heat treated aluminum oxide, alumina-based ceramics, silicon carbide, zirconia, alumina-zirconia, garnet, emery, diamond, ceria, cubic boron nitride, ground glass, quartz, titanium diboride, sol gel abrasives and combinations thereof. The abrasive particles 18 can be either shaped (e.g., rod, triangle, or pyramid) or unshaped (i.e., irregular). The term "abrasive particle" encompasses abrasive grains, agglomerates, or multi-grain abrasive granules. The abrasive particles can be deposited onto make coat 16 by any conventional technique such as electrostatic coating or drop coating.

In general, abrasive article (sandpaper) 10 may be made by providing any suitable backing layer 12 (e.g., a paper or cloth backing), coating an adhesive make coat 16 on one major surface of the backing layer, at least partially embedding abrasive particles 18 in the make coat, thereby forming an abrasive surface, and forming a fibrous non-slip layer 14 on the first major side of the backing layer opposite the make coat. These operations may be performed in any suitable order; the choice of the most convenient order and/or technique may depend e.g. on the particular configuration and materials of fibrous non-slip layer 14 and/or backing 12.

In cases in which fibrous non-slip layer 14 has suitable properties to be handled as a free-standing nonwoven fibrous web (defined as meaning a web that is not residing on a support layer 24 that is permanently incorporated into article 10, but not excluding that the web may be delivered to a lamination process on a temporary liner), non-slip layer 14 may be brought into proximity to the first major side of backing 12 while in such free-standing form, and laminated thereto. If non-slip layer 14 has a composition that facilitates bonding directly to surface 12*a* of backing 12, layer 14 may be bonded directly thereto, e.g. producing a structure of the general type illustrated in FIG. 1. Alternatively, an adhesion-enhancing layer 20 may be used to enhance, or to perform, the adhering of non-slip layer 14 to backing 12, e.g. producing a structure of the general type illustrated in FIG. 6. Layer 20 may comprise an adhesion-promoting layer (e.g. a primer layer, tie layer, or the like) which might be applied e.g. to major surface 12*a* of backing layer 12, to major surface 14*b* of non-slip layer 14, or both. In some instances, layer 20 may comprise an adhesive layer, e.g. a laminating adhesive (whether thermoactivatable, or a pressure-sensitive adhesive). If desired, multiple adhesion-enhancing layers 20 (e.g., one or more adhesive layers and one or more tie or primer layers) may be used. In any of these cases, fibrous non-slip layer 14 may comprise any of the fibrous webs mentioned herein, e.g. a nonwoven fibrous layer such as a spunbonded web, a meltblown web, a carded web, and air-laid web, or a wet-laid web; a woven web; a knitted cloth; and so on.

By way of other examples, in order to make an article 10 e.g. of the general type illustrated in FIG. 7, in which fibrous non-slip layer 14 is provided as part of a multilayer structure comprising a support layer 24, which multilayer structure is laminated to backing 12, fibrous non-slip layer 14 may first be deposited or formed upon support layer 24 by any suitable method. For example, non-slip layer 14 may comprise any fibrous web that is adhered to support layer 24, directly or indirectly. (This process may be performed in-line with the laminating of the resulting multilayer structure to backing 12; or, the multilayer structure may be rolled up and stored until laminated to backing 12 in a separate operation.) The multilayer structure comprising support layer 24 and fibrous non-slip layer 14 thereupon may be laminated to the first major side of backing 12 (with major surface 14*a* of non-slip layer 14 facing outward so as to be an exposed surface) by any suitable method. For example, in the exemplary embodiment shown in FIG. 7, a laminating adhesive 20 may be used to bond to major surface 24*b* of support layer 24 and to major surface 12*a* of backing 12. In embodiments in which support layer 24 is of suitable composition to serve as an adhesive layer, surface 24*b* of support layer 24 may be bonded directly to major surface 12*a* of backing 12.

In some embodiments, it may be convenient to form fibrous non-slip layer 14 (whether directly atop backing layer 12, or atop an adhesive layer or adhesion-promoting layer thereon, or atop a supporting layer 24 which may then be laminated to backing 12) by deposition of unbonded fibers 15 (meaning fibers that are not bonded to each other to form a web prior to being deposited) thereon. In some embodiments, this may be performed by depositing, e.g. under the influence of gravity or some other motivating force, the unbonded fibers onto the desired layer. In some embodiments, this might be performed by using the desired layer (e.g., backing 12 or support layer 24) as a fiber-collecting substrate in a fiber-formation and/or fiber-processing apparatus (e.g., a melt-spinning, melt-blowing, or air-laying process). In variations of this, such unbonded fibers may be collected upon a carrier (such as an endless belt, or a roll), or upon a temporary (e.g., disposable) liner, as a fibrous mat. (In this regard it is noted that as used herein the term mat denotes a mass of collected unbonded fibers, while the term web is used to denote a fibrous mat in which at least some fibers have been bonded to each other to form a self-supporting web.) The fibrous mat can then be transferred from the carrier or temporary liner onto the desired layer and bonded thereto (noting that the fibrous mat may or may not be processed into a bonded-fiber web prior to the transfer). Those of ordinary skill will appreciate that in such approaches, fibers 15 may be formed into fibrous non-slip layer 14 while substantially in a continuous form (i.e., as made in the original fiber-formation process, without having been chopped into shorter lengths). In some embodiments, fibers 15 (regardless of how they were originally made) may be chopped into shorter lengths (often called staple fibers) prior to being formed into fibrous non-slip layer 14. Such staple fibers may be deposited e.g. with the aid of gravity and/or forceful air pressure (e.g., in the well-known air-laying processes). They can be melt-bonded to the substrate upon which they are deposited, if their composition permits; or, an adhesive layer can be provided. (For example, the fibers can be deposited on a hot-melt adhesive layer which is then cooled to solidify and retain the fibers.) In some approaches, fibers can be imparted with an electric charge and the electrostatically motivated to impinge upon a surface (often, a surface bearing an adhesive), in a process known to those of ordinary skill as flocking.

In general with regard to the herein-discussed lamination processes, by lamination is meant bonding of sheet-like substrates or layers to each other, as achieved by bringing the surfaces of the layers (or any adhesion-enhancing layer as might be present thereon, as discussed elsewhere herein) into contact with each other, optionally facilitated by heat and/or pressure, e.g. depending on the type of adhesive and bonding mechanism. For example, if fibrous non-slip layer 14 comprises a heat-bondable (thermoactivatable) composition, and/or if adhesion-enhancing layer 20 comprises a heat-bondable composition, the laminating process may comprise heating the compositions up to appropriate temperatures e.g. by placing the layers between one or more pairs of heated surfaces (e.g., of nip rollers or of heated platens) that press the layers against each other. If adhesion-enhancing layer 20 comprises a pressure-sensitive adhesive composition, such pairs of pressing surfaces (e.g. nip rolls) may still be used; however the laminating process may not necessarily require significantly elevated temperatures (although at least some slightly elevated temperature may be preferred in order to promote optimal wet-out of the pressure-sensitive adhesive).

In some embodiments, it may be convenient to provide at least backing 12 as a roll good, and likewise to provide at least fibrous non-slip layer 14 (or, a multilayer construction comprising at least non-slip layer 14 and a support layer 24) as a roll good, and to perform the lamination by way of passing the components through one or more pairs of nip rollers, as will be familiar to those of ordinary skill. However, if desired discrete sheets rather than roll goods may be used; such sheets may be passed piecewise through nip rolls, or may be laminated between (non-rotating) platens, again as will be familiar to those of ordinary skill.

In many instances, it may be convenient to provide backing layer 12, make coat 16, and abrasive particles 18 in the form of a pre-formed (i.e. otherwise complete) abrasive sheet (whether discrete sheets or as a roll good) and then form fibrous non-slip layer 14 on the first major side thereof, by any of the methods disclosed above.

Any suitable pre-formed abrasive (whether sheet or roll good) may be used, comprising a wide variety of commercially available conventional sandpaper constructions having a wide variety of backing materials (e.g. papers, films, cloths), weights (e.g. A, B, or C weight paper), and abrasive particles. Representative examples of suitable pre-formed abrasive articles include various products available from 3M Company (e.g., under the SandBlaster or Pro Grade trade designations) with FEPA ratings ranging from e.g. P40 to P2500.

In a specific embodiment, sandpaper 10 as disclosed herein may be provided to an end user as a standard 9×11 inch sheet. In other embodiments, the sandpaper 10 may have a width of about 3 to about 4 inches, or of about 5 to about 6 inches, and a length of about 8 to about 10 inches, or about 10 to about 12 inches. In another aspect, the present invention provides a package of sandpaper including a stack of sheets of sandpaper. The stack may include at least 2 sheets, at least about 6 sheets, or at least about 10 sheets. Optionally, disposable liners, protective films, etc. may be provided in between the sheets, if desired. In some embodiments, sandpaper 10 may be provided to an end user as a roll good which may be used in this form or from which individual sheets may be separated as desired.

In some end use applications, the sheet-like abrasive article (e.g., sandpaper) 10 may be used for hand sanding a work surface, such as a wooden surface or work piece. That is, the abrasive article 10 may be used to remove material from a surface by holding the abrasive article 10 directly with one's hand (i.e. without the aid of a tool, such as a sanding block), and moving the abrasive article 10 against the work surface. Thus in this context hand sanding is distinct from operations in which sandpaper is held and motivated by a device such as a polishing shoe, vibrating or orbital sander, and the like. However, it will be recognized that the abrasive articles disclosed herein may also be used with manually-operated sanding tools and sanding blocks, or with powered equipment, as may be desired.

In use, users may often fold an abrasive article (e.g., sandpaper), thereby producing sheets that are easier to handle by hand. Folding the sandpaper, however, may weaken the sandpaper along the fold line, particularly if, during sanding, the sections of the folded sandpaper slip relative to each other so that the fold line traverses (moves) along the sandpaper. Such moving of a fold line along an abrasive article may e.g. cause the backing to weaken, crack, etc. over portions of the article, and may thus reduce the working life of the abrasive article. It has been discovered that the use of a non-slip layer on the first major side of an abrasive article may minimize or prevent such slippage from occurring. That is, in hand sanding with an abrasive sheet that is folded upon itself so that areas of the non-slip layer of the article first major side are adjacent each other in closely facing relation, even in the presence of loose particulates the non-slip layer areas may be able to maintain contact with each other, and to resist slipping relative to each other, so that the sheet remains largely in the originally folded configuration rather than the areas slipping relative to each other such that the fold in the sheet traverses along the sheet. This may be advantageous and may e.g. prolong the working life of the abrasive sheet. Such discoveries, and further details of non-slip layers, are discussed in further detail in U.S. Patent Application Publication 2009/0325470 to Petersen, entitled Sandpaper With Non-Slip Coating Layer, which is incorporated by reference in its entirety herein.

In some instances, (e.g., with particularly coarse grades of sandpaper, e.g., with FEPA grades of P100, P80, P60, or P40, and/or in situations in which large amounts of particulate debris may be present), it may be advantageous for at least some of the fibers of fibrous non-slip layer 14 to comprise certain compositions, e.g. chosen from those comprising at least one base resin and at least one tackifying resin. Such compositions and uses thereof are described in further detail in U.S. Provisional Patent Application Ser. No. 61/451,680 to Petersen et al., filed Mar. 11, 2011, entitled Sandpaper With Non-Slip Layer, and in U.S. Provisional Patent Application Ser. No. 61/451,678 to Petersen et al., filed Mar. 11, 2011, entitled Coarse Sandpaper With Non-Slip Coating layer, both of which are incorporated by reference in their entirety herein.

In some cases, fibrous non-slip layer 14 may comprise a fibrous layer that is laminated to backing layer 12 as mentioned herein. Further details of laminated non-slip layers and lamination processes are described in U.S. Provisional Patent Application Ser. No. 61/498,673 to Petersen, filed evendate with the present application, and entitled Sandpaper With Laminated Non-Slip Layer, which is incorporated by reference in its entirety herein.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention. Thus, the scope of the present invention should not be limited to the specific illustrative structures described herein, but rather extends at least to the structures described by the language of the claims, and the equivalents of those structures. To the extent that there is a conflict or discrepancy between this specification and the disclosure in any document incorporated by reference herein, this specification will control.

List of Exemplary Embodiments

Embodiment 1. A sheet of sandpaper, comprising: a flexible backing layer having opposed first and second major sides; an adhesive make coat on the second major side of the backing layer; abrasive particles at least partially embedded in the make coat, thereby defining an abrasive surface; and an exposed fibrous non-slip layer on the first major side of the backing layer.

Embodiment 2. A sheet of sandpaper as defined in embodiment 1, wherein the fibrous non-slip layer is in contact with a first major surface of the first major side of the flexible backing layer and is bonded directly thereto. Embodiment 3. A sheet of sandpaper as defined in any of embodiments 1-2 wherein at least some of the fibers of the fibrous non-slip layer are bonded to each other at points of fiber intersection.

Embodiment 4. A sheet of sandpaper as defined in any of embodiments 1 and 3 further comprising at least one adhesion-enhancing layer at least a portion of which is between at least a portion of the fibrous non-slip layer and a portion of the backing layer, wherein the adhesion-enhancing layer is chosen from the group consisting of a primer layer, a tie layer, and a pressure-sensitive adhesive layer.

Embodiment 5. A sheet of sandpaper as defined in embodiment 4 wherein the fibers of the fibrous non-slip layer are bonded directly to the adhesion-enhancing layer but are not bonded to each other.

Embodiment 6. A sheet of sandpaper as defined in embodiment 4, further comprising at least one support layer at least a portion of which is between at least a portion of the fibrous non-slip layer and a portion of the adhesion-enhancing layer and to which at least a portion of the fibrous non-slip layer is bonded, either directly or indirectly.

Embodiment 7. A sheet of sandpaper as defined in any of embodiments 1-6, wherein the non-slip layer has an average peak static coefficient of friction of at least about 1 gram when measured according to ASTM D 1894-08.

Embodiment 8. A sheet of sandpaper as defined in any of embodiments 1-7, wherein at least a portion of the material comprising at least some of the fibers of the fibrous non-slip layer comprises an amorphous base resin and an effective amount of a tackifying resin.

Embodiment 9. A method of making a sheet of sandpaper having a fibrous non-slip layer on the first major side thereof, comprising the steps of: providing a flexible backing layer having opposed first and second major sides; coating an adhesive make coat on the second major side of the backing layer; at least partially embedding abrasive particles in the make coat, thereby forming an abrasive surface; and, forming an exposed fibrous non-slip layer on the first major side of the backing layer.

Embodiment 10. The method of embodiment 9 wherein the method comprises laminating a free-standing nonwoven fibrous web onto the first major side of the backing layer to form the exposed fibrous non-slip layer.

Embodiment 11. The method of embodiment 10 wherein the method comprises bonding the free-standing nonwoven fibrous web directly to the first major surface of the first major side of the backing layer.

Embodiment 12. The method of embodiment 10 wherein the method comprises providing at least one adhesion-enhancing layer at least a portion of which is between at least a portion of the backing layer and at least a portion of the free-standing nonwoven fibrous web, and wherein the method comprises bonding at least a portion of the free-standing nonwoven fibrous web directly to at least a portion of the adhesion-enhancing layer.

Embodiment 13. The method of embodiment 12 wherein the method comprises depositing an adhesive layer on the first major side of the backing layer and/or on a major side of the free-standing nonwoven fibrous web and then bonding the backing layer and the free-standing nonwoven fibrous web layer together by way of the adhesive layer.

Embodiment 14. The method of embodiment 9 wherein the method comprises laminating a multilayer structure comprising a nonwoven fibrous web bonded to a supporting layer onto the first major side of the backing layer so that the nonwoven fibrous web forms the exposed fibrous non-slip layer.

Embodiment 15. The method of embodiment 14 wherein the method comprises depositing an adhesive layer on the first major side of the backing layer and/or on a major side of the supporting layer of the multilayer structure and then bonding the backing layer and the multilayer structure together by way of the adhesive layer Embodiment 16. The method of embodiment 9 wherein the method comprises depositing unbonded fibers onto a first major surface of the first major side of the backing layer or onto a major surface of an adhesion-enhancing layer thereon, and then bonding the fibers to the first major surface of the backing layer or to the major surface of the adhesion-enhancing layer, so as to form the fibrous non-slip layer.

Embodiment 17. The method of embodiment 16 wherein the unbonded fibers are formed in a melt-spinning, melt-blowing, or solvent-spinning process, and after being formed in such process are deposited on the first major side of the backing layer without having been chopped.

Embodiment 18. The method of embodiment 16 wherein the unbonded fibers are chopped fibers.

Embodiment 19. The method of embodiment 18 wherein one or more adhesive layers are provided on at least a portion of the first major side of the backing layer and wherein the chopped fibers are contacted with the adhesive layer and bonded thereto, and wherein the adhesive layer is chosen from the group consisting of pressure-sensitive adhesives, hot-melt adhesives, hardenable adhesives, drying adhesives, and photohardenable adhesives.

Embodiment 20. The method of embodiment 19 wherein the chopped fibers are deposited onto the adhesive layer by an air-laying process, a gravity-driven process, or an electrostatically-driven flocking process.

Embodiment 21. The method of embodiment 16 wherein the method comprises: delivering an unbonded-fiber mat to the first major side of the backing layer while the unbonded-fiber mat is residing on a carrier or a temporary liner; laminating the unbonded-fiber mat onto the first major side of the backing layer; and, separating the carrier or the temporary liner from the unbonded mat so that the unbonded-fiber mat forms the exposed fibrous non-slip layer.

Embodiment 22. A method of hand sanding a work surface comprising the steps of: providing a sheet of sandpaper as defined in any of embodiments 1-8; manually engaging the exposed fibrous non-slip layer with a human hand; and manually moving the sandpaper in a plurality of directions over the work surface.

Embodiment 23. A method of hand sanding a work surface comprising the steps of: providing a sheet of sandpaper made by a method as defined in any of embodiments 9-21; manually engaging the exposed fibrous non-slip layer with a human hand; and manually moving the sandpaper in a plurality of directions over the work surface.

What is claimed is:

1. A sheet of sandpaper, comprising:

a flexible backing layer having opposed first and second major sides;

an adhesive make coat on the second major side of the backing layer;

abrasive particles at least partially embedded in the make coat, thereby defining an abrasive surface; and an exposed fibrous non-slip layer on the first major side of the backing layer, wherein at least some fibers of the fibrous non-slip layer are bonded to each other at points of fiber intersection.

2. A sheet of sandpaper as defined in claim 1, wherein the fibrous non-slip layer is in contact with a first major surface of the first major side of the flexible backing layer and is bonded directly thereto.

3. A sheet of sandpaper as defined in claim 1, wherein the non-slip layer has an average peak static coefficient of friction of at least about 1 gram when measured according to ASTM D 1894-08.

4. A sheet of sandpaper as defined in claim 1, wherein at least a portion of a material comprising at least some fibers of the fibrous non-slip layer comprises an amorphous base resin and an effective amount of a tackifying resin.

5. A sheet of sandpaper as defined in claim 1, wherein the exposed fibrous non-slip layer is a thermoactivatable fibrous web.

6. A sheet of sandpaper as defined in claim 1, wherein the flexible backing layer is a paper layer.

7. A sheet of sandpaper as defined in claim 1, wherein the sheet of sandpaper consists essentially of:

the flexible backing layer having opposed first and second major sides;

the adhesive make coat on the second major side of the backing layer;

the abrasive particles at least partially embedded in the make coat, thereby defining an abrasive surface; and the exposed fibrous non-slip layer on the first major side of the backing layer.

8. A sheet of sandpaper as defined in claim 7, wherein the exposed fibrous non-slip layer is a thermoactivatable fibrous web and wherein the flexible backing layer is a paper layer.

9. A sheet of sandpaper as defined in claim 1, wherein the exposed fibrous non-slip layer on the first major side of the backing layer consists essentially of a multiplicity of fibers that are arranged so that surfaces of the fibers collectively provide an exposed major surface of the exposed fibrous non-slip layer.

10. A sheet of sandpaper as defined in claim 1, wherein at least some fibers of the fibrous non-slip layer are multicomponent fibers.

11. A sheet of sandpaper as defined in claim 1, wherein the fibrous non-slip layer is chosen from the group consisting of a spunbonded web, a meltblown web, a carded web, an airlaid web, a wet-laid web, a woven web, and a knitted cloth.

12. A sheet of sandpaper, comprising:

a flexible backing layer having opposed first and second major sides;

an adhesive make coat on the second major side of the backing layer;

abrasive particles at least partially embedded in the make coat, thereby defining an abrasive surface; and an exposed fibrous non-slip layer on the first major side of the backing layer, wherein the exposed fibrous non-slip layer on the first major side of the backing layer consists essentially of a multiplicity of fibers that are arranged so that surfaces of the fibers collectively provide an exposed major surface of the exposed fibrous non-slip layer.

13. A sheet of sandpaper as defined in claim 12, wherein the fibrous non-slip layer is in contact with a first major surface of the first major side of the flexible backing layer and is bonded directly thereto.

14. A sheet of sandpaper as defined in claim 12, wherein the non-slip layer has an average peak static coefficient of friction of at least about 1 gram when measured according to ASTM D 1894-08.

15. A sheet of sandpaper as defined in claim 12, wherein at least a portion of a material comprising at least some fibers of the fibrous non-slip layer comprises an amorphous base resin and an effective amount of a tackifying resin.

16. A sheet of sandpaper as defined in claim 12, wherein the exposed fibrous non-slip layer is a thermoactivatable fibrous web.

17. A sheet of sandpaper as defined in claim 12, wherein the flexible backing layer is a paper layer.

18. A sheet of sandpaper as defined in claim 12, wherein the sheet of sandpaper consists essentially of:

the flexible backing layer having opposed first and second major sides;

the adhesive make coat on the second major side of the backing layer;

the abrasive particles at least partially embedded in the make coat, thereby defining an abrasive surface; and the exposed fibrous non-slip layer on the first major side of the backing layer.

19. A sheet of sandpaper as defined in claim 18, wherein the exposed fibrous non-slip layer is a thermoactivatable fibrous web and wherein the flexible backing layer is a paper layer.

20. A sheet of sandpaper as defined in claim 12, wherein at least some fibers of the fibrous non-slip layer are multicomponent fibers.

21. A sheet of sandpaper as defined in claim 12, wherein the fibrous non-slip layer is chosen from the group consisting of a spunbonded web, a meltblown web, a carded web, an airlaid web, a wet-laid web, a woven web, and a knitted cloth.

* * * * *

UNITED STATES PATENT AND TRADEMARK OFFICE

CERTIFICATE OF CORRECTION

PATENT NO. : 9,114,505 B2
APPLICATION NO. : 13/489530
DATED : August 25, 2015
INVENTOR(S) : John Petersen It is certified that error appears in the above-identified patent and that said Letters Patent is hereby corrected as shown below:

IN THE SPECIFICATION

Column 6
Line 52, Delete "anyhydrides," and insert -- anhydrides, --, therefor.

Column 7
Line 56, Delete "napthenic" and insert -- naphthenic --, therefor.

Column 12
Line 20, Delete "backing" and insert -- backing. --, therefor.

Column 16
Line 51, Delete "61/498,673" and insert -- 61/498,673 (Attorney Docket No. 67398US002) --, therefor.

Signed and Sealed this
Twenty-second Day of March, 2016

Michelle K. Lee

Michelle K. Lee
*Director of the United States Patent and Trademark Office*